US005392960A

United States Patent [19]

Kendt et al.

[11] Patent Number: 5,392,960

[45] Date of Patent: Feb. 28, 1995

[54] POSTMIX BEVERAGE DISPENSER AND A METHOD FOR MAKING A BEVERAGE DISPENSER

[75] Inventors: Norman L. Kendt, Trumbull; Robert Bordonaro, Torrington, both of Conn.

[73] Assignee: Wilshire Partners, Cleveland, Ohio

[21] Appl. No.: 976,343

[22] Filed: Nov. 13, 1992

[51] Int. Cl.[6] ..... B67D 5/56

[52] U.S. Cl. ..... 222/129.1; 62/396; 222/146.6; 285/334.5; 285/369

[58] Field of Search ..... 222/129.1, 146.6; 285/302, 332.3, 334.5, 369, 383; 62/389, 390, 396, 398

[56] References Cited

U.S. PATENT DOCUMENTS

| | | | |
|---|---|---|---|
| 2,037,812 | 4/1936 | McKendrick | 285/334.5 X |
| 3,635,499 | 1/1972 | Reddy | 285/332.3 X |
| 3,853,244 | 12/1974 | Neumann | 222/129.1 |
| 4,066,283 | 1/1978 | Struck | 285/369 X |
| 4,076,280 | 2/1978 | Young | 285/334.5 X |
| 4,281,856 | 8/1981 | Litman et al. | 285/369 X |
| 4,291,546 | 9/1981 | Rodth | 62/398 |
| 4,555,045 | 11/1985 | Rodth et al. | 222/129.1 X |
| 4,651,538 | 3/1987 | Bull et al. | 62/398 |
| 4,730,463 | 3/1988 | Stanfill | 222/146.6 X |
| 4,805,806 | 2/1989 | Smith | 222/146.6 |
| 5,249,710 | 10/1993 | Hassell et al. | 222/146.6 |

OTHER PUBLICATIONS

Selmix Brochure "Concord".
Selmix Brochure "York".
Selmix Brochure "Revere".

*Primary Examiner*—Andres Kashnikow
*Assistant Examiner*—Joseph A. Kaufman
*Attorney, Agent, or Firm*—Vickers, Daniels & Young

[57] ABSTRACT

A beverage dispenser provides uniformly chilled carbonated beverages during peak demand and off-peak demand. The dispenser includes a soda and syrup chiller, beverage dispensing heads and a vacuum insulated tower assembly between the chiller and the dispensing heads.

45 Claims, 12 Drawing Sheets

POSTMIX BEVERAGE DISPENSER AND A METHOD FOR MAKING A BEVERAGE DISPENSER

BACKGROUND OF THE INVENTION

This invention relates to a postmix beverage dispenser and in particular to a beverage dispenser with improved low temperature holding characteristics and a method for making such a dispenser.

Carbonated beverages are sold in restaurants, snack shops, amusement parks, fast food outlets and other establishments throughout the world. Many of these beverages are mixed and dispensed on the spot in postmix beverage dispensers. Generally, a postmix beverage dispenser is provided with a plurality of flavoring syrups and carbonated water which are chilled and mixed within the dispenser and poured into a cup or glass. It is desirable to dispense beverages at a uniform low temperature. Dispensing of a consistently cold beverage results in a more uniform mix of syrup and soda water and also allows better retention of carbonation in the beverage.

Postmix beverage dispensers generally comprise at least one soda conduit carrying carbonated water to a soda manifold, a plurality of syrup conduits carrying flavoring syrup, a cooler and a number of dispensing heads. The soda manifold is often positioned near the dispensing heads and feeds soda to the heads through short tubes. The cooler chills the soda and syrup within their respective conduits. The cooler can be a mechanical cooler similar in operation to an air conditioner or it can be an ice chest type cooler. In an ice chest type cooler, the soda and syrup conduits are embedded within an aluminum block in contact with the bottom of a chest of ice. The ice cools the block, which is often called a cold plate, which in turn cools the syrup and soda. The chilled soda and syrup is conveyed from either type of cooler through a tower which supports dispensing heads at a convenient location for filling beverage cups. During peak dispensing time, when a restaurant is serving a meal or the like, the flow of beverage through the beverage dispenser is regular and high. A uniformly chilled product is generally provided. However, in off-peak times, soda and syrup can sit for a long period of time in the conduits through the tower leading to the dispensing heads. The soda and syrup can warm due to exposure to ambient conditions resulting in a less than optimal drink. The problem is generally referred to as the casual drink problem.

In the past, people have sought to address the casual drink problem by various means. One mechanism was simply the insulation of the tower area by the filling of it with a insulation material. However, access openings and loose insulation are often required in the manufacturing process. Over a long period of time, the material within the soda and syrup tubes in the tower would still warm. Other approaches included recirculating soda water through the soda conduits in an effort to chill the conduits. Mechanical answers to the casual drink problem are complicated, subject to failure, noisy and sometimes disturbing to operators. Heretofore, the casual drink problem has not been adequately addressed and less than optimal beverages which are flat, mismixed and otherwise unacceptable to soft drink manufacturers and/or consumers have been served.

These and other problems are overcome by the present invention wherein a postmix beverage dispenser adapted to provide uniformly chilled beverages is described.

SUMMARY OF THE INVENTION

In accordance with the present invention there is provided a postmix beverage dispenser in which the syrup and soda conduits from a cooler to several beverage dispensing heads are vacuum insulated over a major portion of their life.

Still further in accordance with the invention, the vacuum insulation of the syrup and soda conduits takes the form of individual vacuum insulated conduits embedded in a matrix of foam insulation within a postmix beverage dispensing tower.

Still further in accordance with the invention, the vacuum insulated syrup and soda conduits from the cooler to the beverage dispensing heads are preassembled into a body of foam insulation prior to assembly of the finished beverage dispenser.

Still further in accordance with the invention, the vacuum insulation can take the form of a front vacuum insulation flat panel and rear vacuum insulation flat panel protecting a central volume in which soda and syrup conduits are embedded in a body of foam insulation.

In accordance with another aspect of the invention, a modular well insulated beverage dispenser comprises an ice chest assembly and a tower assembly which are easily mated to one another to provide a well insulated whole. The ice chest assembly has a body of foamed in place insulation protecting the syrup and soda tubes and a top surface from which the tubes protrude. The tower assembly has a body of foamed in place insulation protecting syrup and soda conduits having connector receptacles on their lower ends which receive the tubes from the ice chest assembly providing a well insulated whole.

Yet further in accordance with the invention, a soda manifold having at least one soda inlet and a soda outlet for each dispensing head is embedded in the cold plate.

Still further in accordance with the invention, a cold plate fin of thermally conductive material is connected to the cold plate and in contact with portions of the soda and syrup conduits over a portion of their length downstream from the cold plate.

Still further in accordance with the invention, connectors are provided on the bottom end of the syrup and soda conduits within the preassembled tower insulation allowing a certain amount of mismatch in connection to the tubes exiting the cooler.

Yet further in accordance with the invention, connectors are provided on the bottom of the conduits consisting of sleeves permanently fixed to the bottom of the conduits within the tower assembly; such sleeves having a central aperture adapted to receive the tubes exiting the cooler. The sleeves are provided with an O-ring sealing around the tubes from the cooler when they are placed within the sleeves and an adhesive is used to complete the connection of the sleeves to the sleeves exiting the cooler.

It is the primary object of the present invention to overcome the warm causal drink problem without the requirement for recirculation of soda or other active mechanical strategies.

It is another object of the present invention to provide a superior insulation characteristic for that portion of a postmix beverage dispenser downstream from the cold plate.

It is still another object of the present invention to provide a mechanism for keeping soda chilled in a soda manifold within a cold plate in a postmix beverage dispenser.

It is still another object of the present invention to provide a method of manufacturing a postmix beverage dispenser in which a vacuum insulated tube assembly is easily and reliably assembled to the other components of the beverage dispenser with little chance of breakage.

It is still another object of the present invention to provide a postmix beverage dispenser having greater resistance to failure in the field due to leaks.

It is still another object of the present invention to provide a method of assembling a postmix beverage dispenser allowing for a slight mismatch between various elements.

It is still another object of the present invention to provide a postmix beverage dispenser capable of providing a uniform, superior soft drink product under peak conditions and off-peak conditions alike.

These and other objects and the advantages of the invention will become apparent from the following description of a preferred embodiment thereof taken together with the accompanying drawings.

BRIEF DESCRIPTION OF THE DRAWINGS

The invention may take physical form in certain parts and arrangements of parts, a preferred embodiment of which is described in detail below and illustrated in the accompanying drawings forming a part hereof wherein.

DETAILED DESCRIPTION OF THE PREFERRED EMBODIMENT

Figure 1:
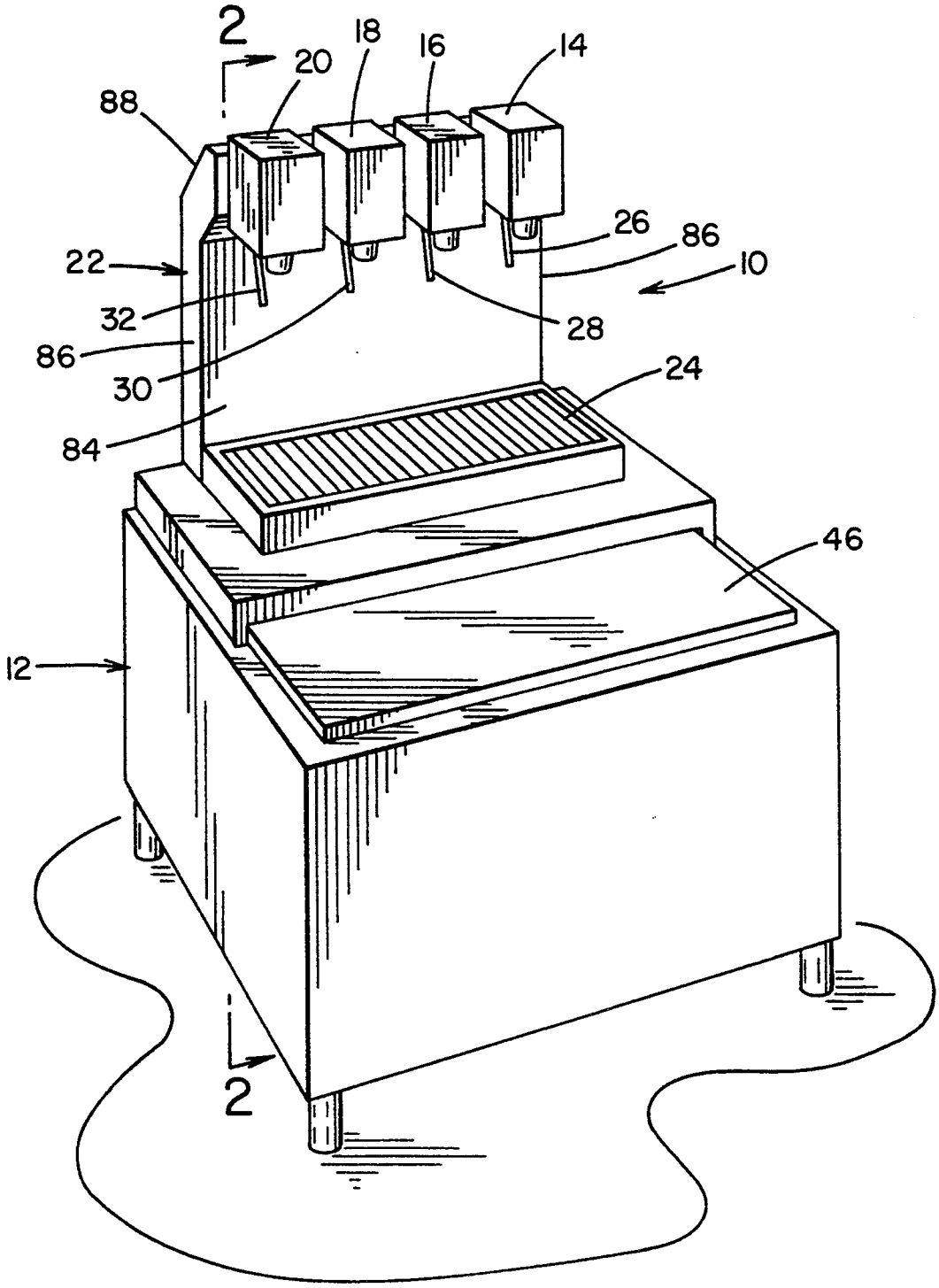
FIG. 1 is a perspective view of a postmix beverage dispenser according to the invention.

Referring now to the drawings wherein the showings are for the purposes of illustrating a preferred embodiment of the invention only and not for the purposes of limiting same, the figures show a postmix beverage dispenser 10 comprised of an ice chest 12, several dispensing heads 14, 16, 18, 20, a tower 22 and a drip pan 24. The ice chest is kept filled with ice in normal operation. Beverage is dispensed through the beverage heads into cups held against one of the actuator levers 26, 28, 30, 32. The drip pan 24 is positioned below the dispensing heads 14, 16, 18, 20 to collect any spillage or overflow and conduct it to a drain.

Figure 2:
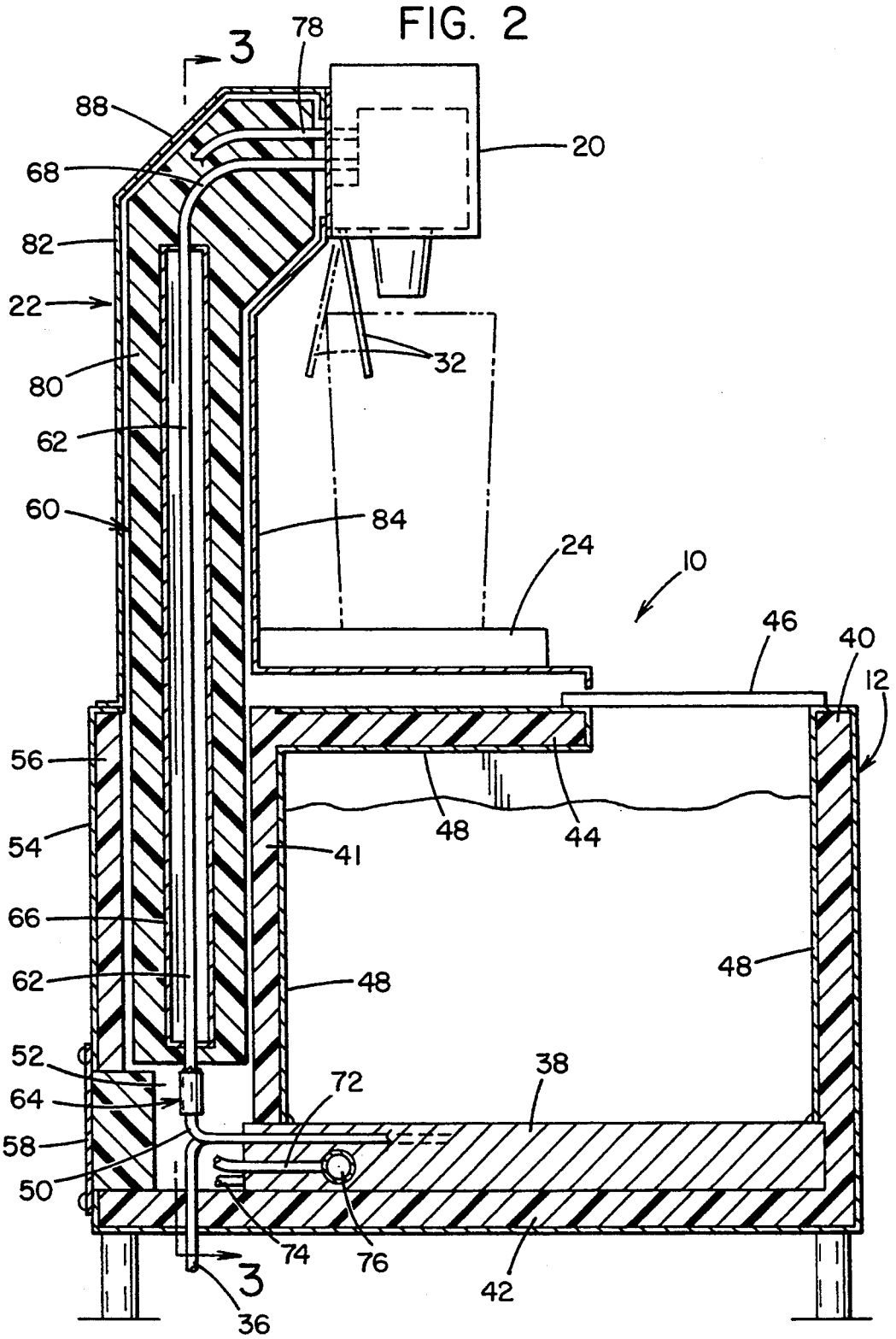
FIG. 2 is a cross section of the dispenser seen in FIG. 1 taken along line 2—2 and showing the tower insulation structure in detail.
Figure 3:
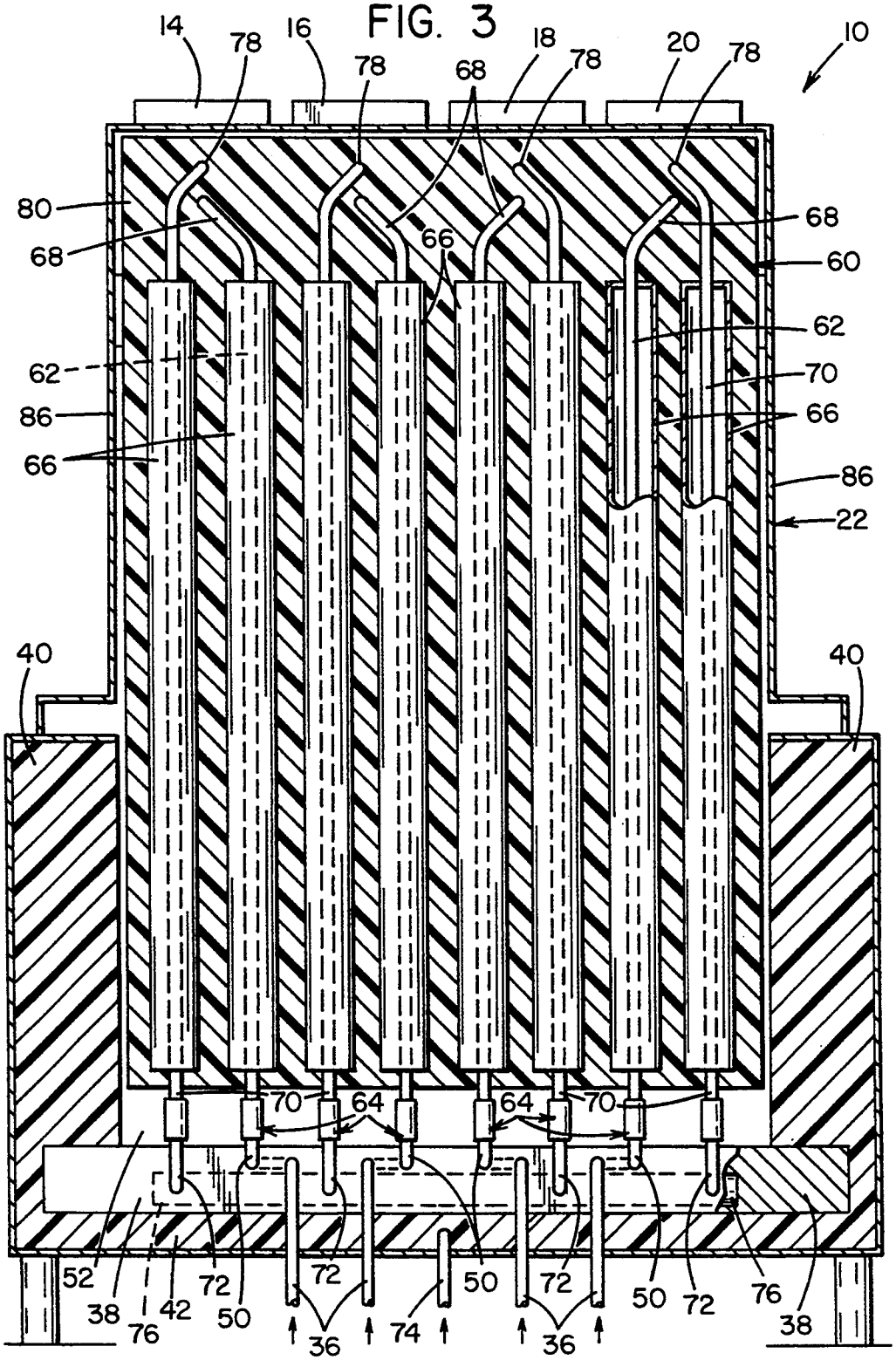
FIG. 3 is a cross section of the tower insulation structure taken line 3—3 of FIG. 2.

FIG. 2 generally shows the flow path for syrup and soda through the dispenser. Syrup flows in an ice chest syrup tube 36 which is imbedded in a cold plate 38 over a substantial portion of its length. The cold plate 38 is normally a block of aluminum which is cast around a number of syrup tubes and soda tubes having sinuous paths within the block of aluminum. The cold plate 38 forms the bottom of the ice chest 12 which is normally kept filled with cube ice or the like and provided with a drain for removal of melted ice. The ice chest 12 is provided with insulated side walls 40 including a rear facing side wall 41 and a bottom insulation 42 under the Cold plate 38. The top of the ice chest is sometimes provided with a top insulator 44 and a door 46 which can be opened to fill the ice chest with ice. The ice chest 12 is lined with water impervious surfaces 48 protecting the insulation 40, 41 and 44 and permanently fixed to the cold plate 38. The bottom insulation 42 extends rearwardly from the ice chest sufficiently to protect an area at the rear of the cold plate 38 containing the exposed exit portion 50 of the syrup tubes 36. The dispenser 10 also includes a rear well 52 defined by the rear facing insulated side wall 41 of the ice chest 12 and the rear wall 54 of the dispenser 10. The rear wall 54 includes a body of insulation 56 extending over its entire width. The rear wall 54 is provided with an insulated access plate 58 extending the entire width of the rear wall. An insulated tower assembly 60 is disposed partially in the well 54. The insulted tower assembly 60 is also shown in FIG. 3. The insulated tower assembly 60 is comprised of a number of syrup conduits 62 having conduit connectors 64 fixed to their lower ends. The conduit connectors 64 are connected to the exit portions 50 of the syrup tubes 36. The syrup conduits 62 are surrounded by vacuum insulation chambers 66 over a major portion of their length. The vacuum insulation chambers 66 are cylindrical in shape and completely surround the syrup conduit 62 providing thermal isolation. A top portion 68 of the syrup conduits 62 extends beyond the vacuum insulation chamber 66, exits the insulated tower assembly 60 and connects to the respective dispensing heads 14, 16, 18, 20. Several identical syrup conduits are disposed within the insulated tower assembly 60. Additionally, several soda conduits 70 are also disposed in the insulated tower assembly 60. The soda conduits are selected to contain a minimum amount of soda in standby while providing adequate flow to each dispensing head. Stainless tubing of 5/16 diameter has been found to be adequate. The soda conduits are surrounded over most of their length by vacuum insulation chambers 66. The soda conduits 70 are fixed to conduit connectors 64 on their lower end which are in turn connected to several soda tubes 72 which receive soda from a manifold 76 imbedded in the cold plate 38. The manifold 76 receives cool, carbonated water from a carbonated water inlet tube 74 which winds sinuously through the cold plate 38 and is attached to a carbonator (not shown). The soda conduit top portions 78 exit the vacuum insulation chamber 66 and connect to the dispensing heads 14, 16, 18, 20 providing chilled soda to the heads. A body of foam insulation 80 completely surrounds the vacuum insulation chambers 66 and most of the top portions of the syrup conduits 62 and soda conduits 70. The body of foam insulation 80 is somewhat rigid and holds the syrup conduits 62 and the soda conduits 70 in place. The body of foam insulation also protects the vacuum insulation chambers 66 from impact or other abuse. The insulated tower assembly 60 is preassembled. That is, the various syrup conduits 62, vacuum insulation chambers 66, soda conduits 70, and conduit connector 64 are assembled and placed in a jig. A mold surrounds the conduits and chambers and foamable insulation material is introduced into the mold. The foamable insulation material expands, filling the mold and cures. After curing, a finished insulated tower assembly having conduit connectors 64 at predetermined locations appropriate for interconnection with syrup tube cold plate exit portions 50 and the ice chest soda tubes 72 is provided. Additionally, soda conduit top portions 78 and syrup conduit top portions 68 are held in a position appropriate for interconnecting to the dispensing heads 14, 16, 18, 20.

The insulated tower assembly 60 is surrounded by a tower rear jacket 82, a tower front jacket 84, and tower side jackets 86. As is best seen in FIG. 2, the tower rear jacket includes a tower top jacket 88 protecting the top of the insulated tower assembly 60.

Figure 15:
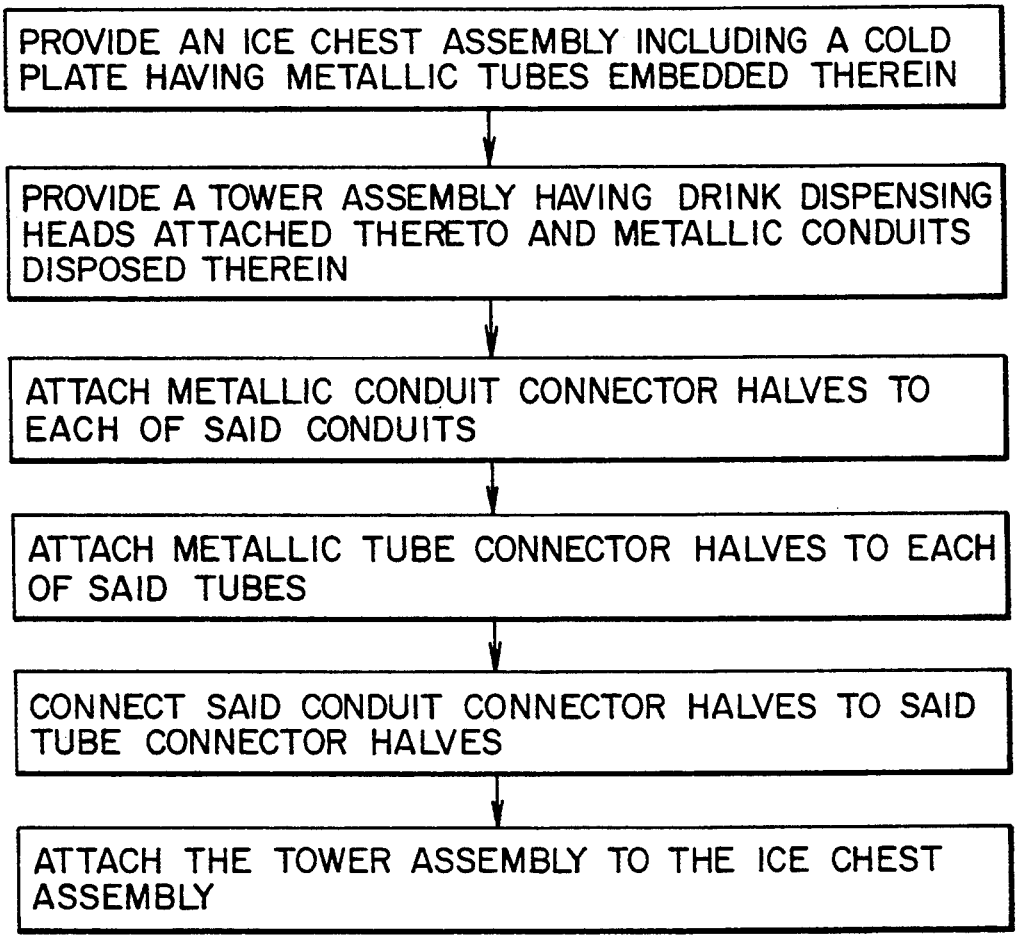
FIG. 15 is a flow chart showing a method of assembling the present invention.

The above described structure is manufactured in a modular manner as shown in FIG. 15. The lower portion including the ice chest 12 and the rear well 52 is constructed. When all of the lower portion parts are assembled, one has an ice chest 12 in which a cold plate forms the bottom of the chest and is permanently assembled into the ice chest. The bottom of the rear well 52 contains the exit portions 50 of each of the syrup tubes 36 and soda tubes 72. The bottom of the rear well 52 is open as the insulated access plate 58 is not yet in place. However, the rear well, is otherwise defined by four insulated sides comprised of the rearwardly extending insulated side walls 40, the rear facing ice chest insulating side wall 41 and the rear wall insulation 56. The preassembled insulated tower assembly 60 is slid into the rear well 52 and the conduit connectors 64 are connected to the syrup exit portions 50 and the ice chest soda tubes 72. The connection can be finished through, the opening provided by the insulated access plate 58. Once the connections are completed, the access plate 58 is fixed in place completely closing the bottom of the rear well 52. Those portions of the tower jacket 82, 84, 86 and 88 not yet assembled to the ice chest 12 are applied and the dispensing heads 14, 16, 18, 20, if not already on the tower assembly, are connected. The postmix beverage dispenser 10 is complete and ready for shipment and installation. Superior insulation of the syrup and soda paths downstream from the cold plate 38 is provided.

A high quality vacuum insulation can lower the thermal conductivity through a given area by a significant factor when compared to an equivalent foam insulation. This can be critical when considering the casual drink problem.

Figure 8:
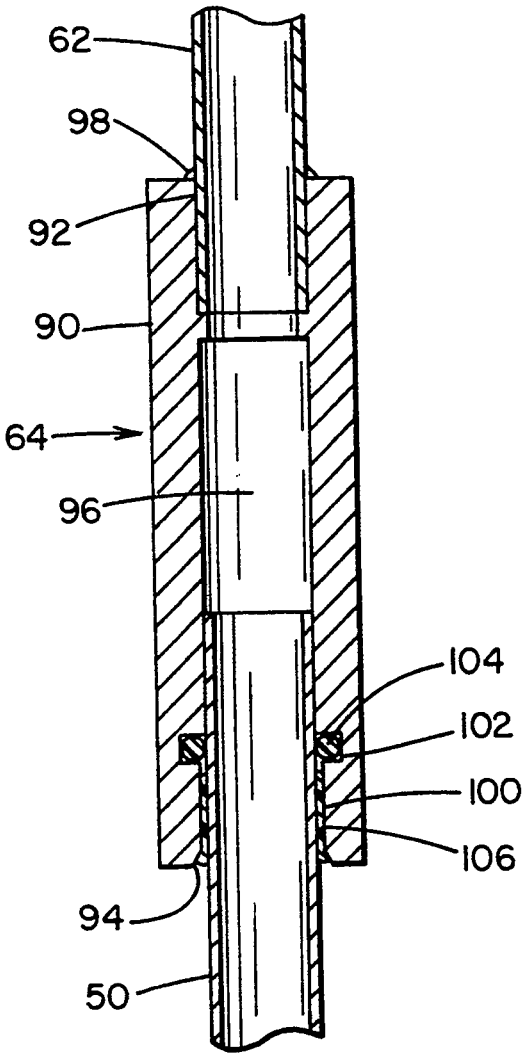
FIG. 8 shows a detail view of a conduit connector used in the present invention.

FIG. 8 shows one embodiment of the connector 64 used in the invention. The connector 64 comprises a tube 90 having a top opening 92 and a bottom opening 94. The top opening 92 and the bottom opening 94 are connected by a central bore 96. The top portion of the central bore 96 has a diameter substantially equal to the outside diameter of the syrup conduit 62. The tube 90 is permanently fixed to the syrup conduit 62 as by a weld 98 or the like. The tube bottom opening 94 is flared somewhat and leads to a slightly enlarged bore bottom portion 100. The bore bottom portion 100 leads to an annular recess 102 accommodating an O-ring 104. The portion of the bore 96 above the O-ring 104 has a diameter only slightly larger than the syrup tube exit portion 50.

The connector is permanently fixed to the insulated tower assembly 60 prior to assembly of the tower assembly 60 of the ice chest 12. When the insulated tower assembly is lowered into the well 52, the bell shaped bottom opening 94 of the connector 64 will slide over the exit portion 50 and the exit portion tube will slide into the connector, past the O-ring and achieve a water tight seal. An annular ring of adhesive 106 is normally placed around the exit portion 50 just prior to assembly to make the connection semi-permanent. The O-ring 104 prevents penetration of the adhesive 106 into the water tight internal areas of the connector 64.

As can be seen in FIG. 8, a substantial length of bore 96 is provided. This allows for considerable mismatch in the length of the ice chest syrup tube exit portion 50 and the lower end of the syrup conduits 62 and conduit connector 64. A mismatch from 0.0 inches to 1.0 inches often occurs and can be accommodated by the present invention.

Figure 9:
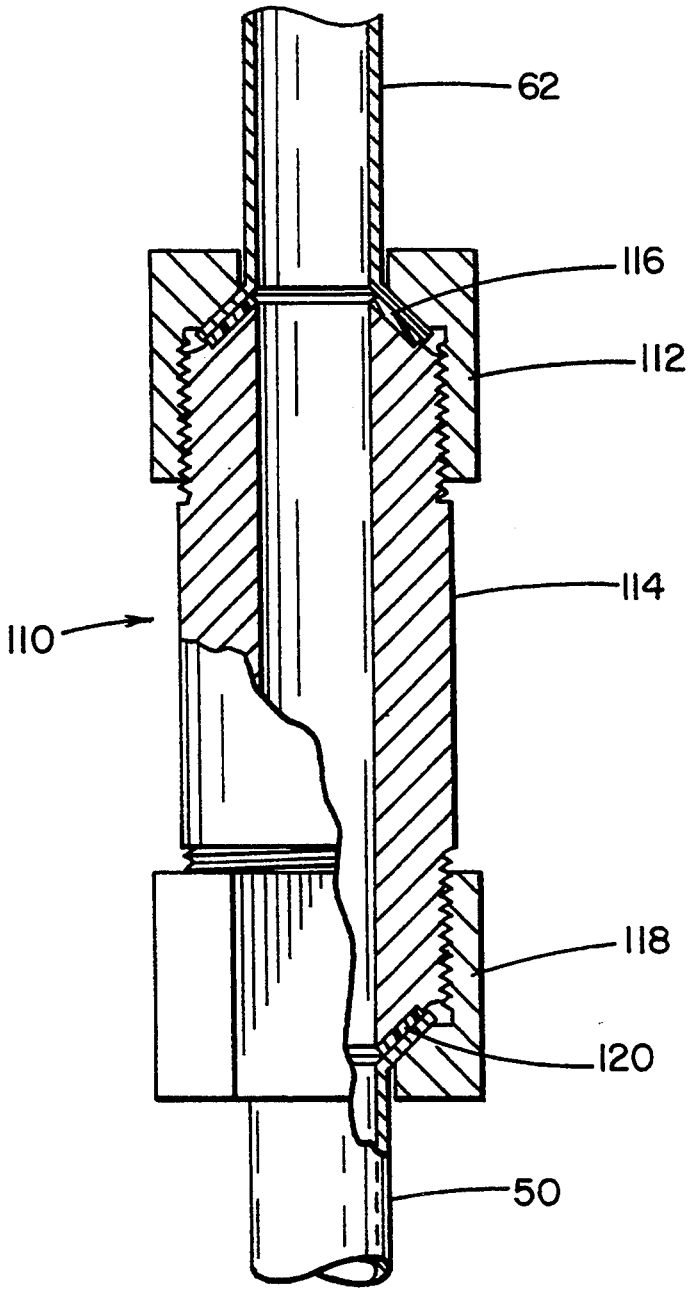
FIG. 9 shows an alternate conduit connector assembly as used in the present invention.
Figure 16:
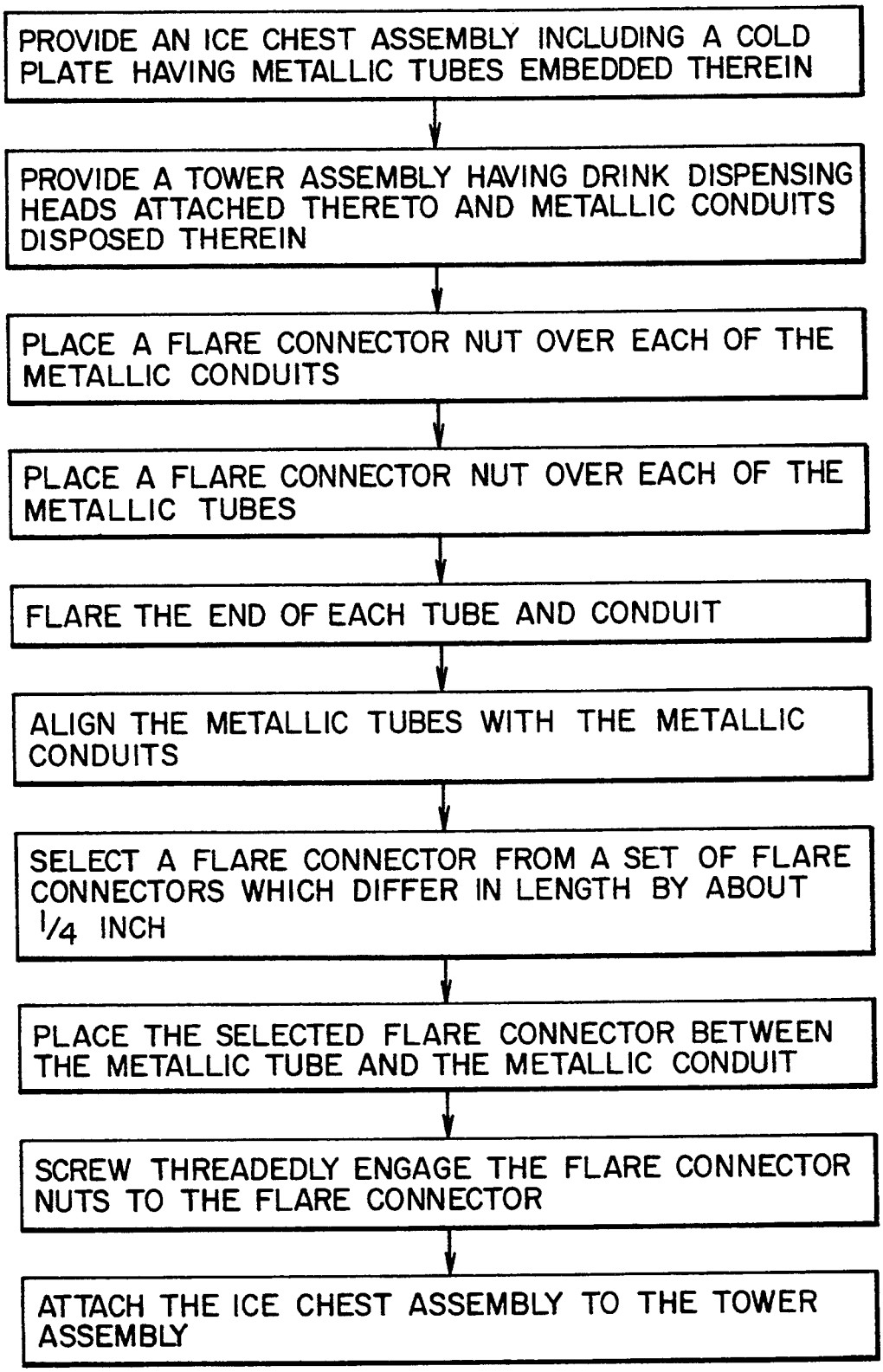
FIG. 16 is a flow chart showing a method of assembling another embodiment of the present invention.

Alternatively, connectors such as those shown in FIG. 9 can be used. In FIG. 9, the syrup conduit 62 is flared at its bottom end after application of a flare connector bodies 114. A flare connector body 114 is provided with threads and connected to the flare connector nut 112 by screwing it in place. A gasket 116 is provided between the upper end of the flare connector body 114 and the flared portion of the syrup conduit 62 to assure a water-tight seal. A flare connector nut 118 identical to the flare connector nut 112 is applied to the exit portion 50 of the ice chest syrup tube 36 and the end of the exit portion is flared. A gasket 120 is placed in the nut and the nut threaded upon the flare connector body 114. In practice, flare connector bodies of various length are provided. This allows for a mismatch in the length of the exit portion 50 and the syrup conduit 62. Several different flare connector bodies varying in length by a quarter inch or the like are available at the assembly point and can be assembled through the insulated access plate 58. FIG. 16 shows the steps of this assembly.

The ice chest syrup tubes 36, the syrup conduits 62, the soda conduits 70 and the ice chest soda tubes 72 are metallic. No plastic tube portions are required to allow for mismatch between the metallic tubes as mismatch is accommodated by the connectors. A more reliable connection is thereby provided.

Figure 6:
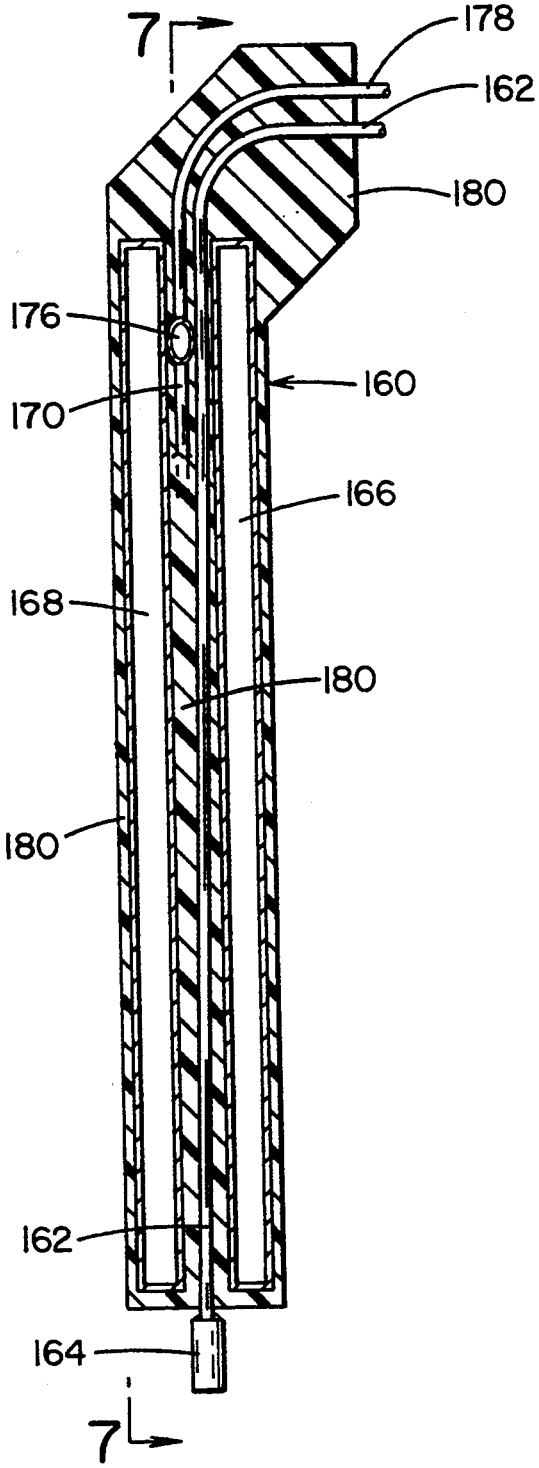
FIG. 6 shows an insulated conduit tower assembly similar to that seen in FIG. 5 but including a soda manifold within the vacuum insulated structure.
Figure 7:
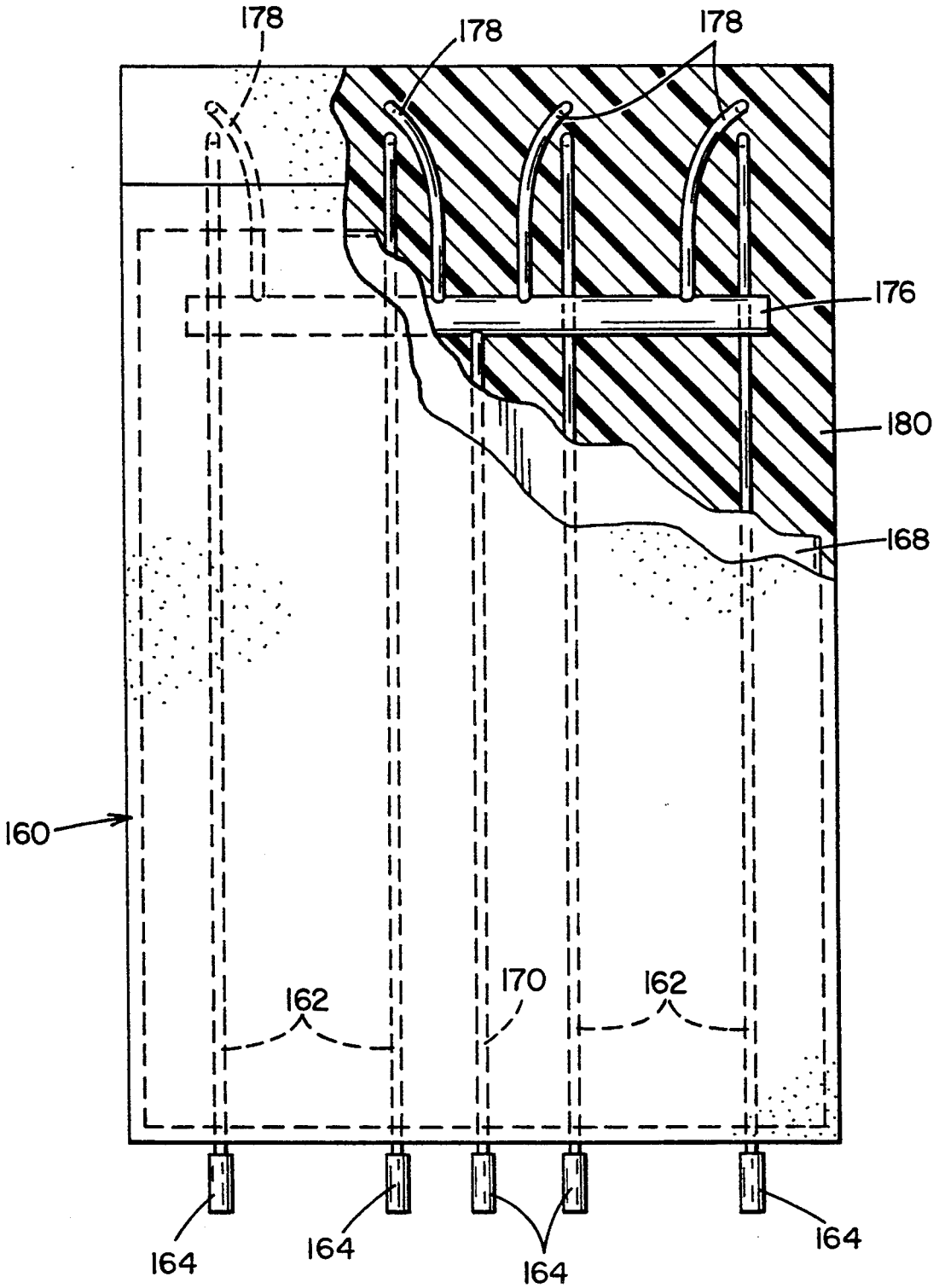
FIG. 7 shows a rear sectional view of the insulated tower assembly of FIG. 6 partially cut away taken along line 7—7 of FIG. 6.

An alternate insulated tower assembly 160 is shown in FIGS. 6 and 7. Several syrup conduits 162 are provided and each syrup conduit 162 is provided with a conduit connector 164. A soda conduit 170 is also provided and has a conduit connector 164 on its lower end. The soda conduit 170 is connected at its top end to a soda manifold 176. The soda manifold 176 is in turn connected to a number of manifold exit tubes 178. A front planar vacuum insulation chamber 166 and a rear vacuum insulation chamber 168 are provided. The front vacuum insulation chamber 166 and the rear vacuum insulation chamber 168 are of substantially identical widths and substantially as high as the insulated tower assembly 160. The syrup conduits 162, the soda conduit 170 and the soda manifold 176 are all positioned between the front vacuum insulation chamber 166 and the rear vacuum insulation chamber 168. The front vacuum insulation chamber 166 and the rear vacuum insulation chamber 168 are fabricated with known techniques and include a honeycomb internal structure or precipitated silica, or granular carbon or the like (not shown) so as to withstand external pressure while maintaining desired shape. The volume between the two vacuum insulation chambers 166, 168 and surrounding the two vacuum insulation chambers is filled with a body of foam insulation 180 which is molded to conform to the shape of the tower 22. As can be seen in FIGS. 6 and 7, this arrangement provides for maximum insulation of the portions of the soda conduit 170 and the syrup conduits 162 downstream from the cold plate 38. Only those portions of the manifold exit lines 178 and syrup conduits 162 travelling from above the vacuum insulation chambers 166, 168 to the dispensing heads 14, 16, 18, 20 are not vacuum insulated. Moreover, those portions not vacuum insulated are embedded in foam insulation 180. The casual drink problem is addressed. It is contemplated that the vacuum insulation chambers 166, 168 may be supplemented by side vacuum insulation chambers as well to completely surround the volume containing the soda conduits 162, soda conduit 170 and soda manifold 176.

Figure 4:
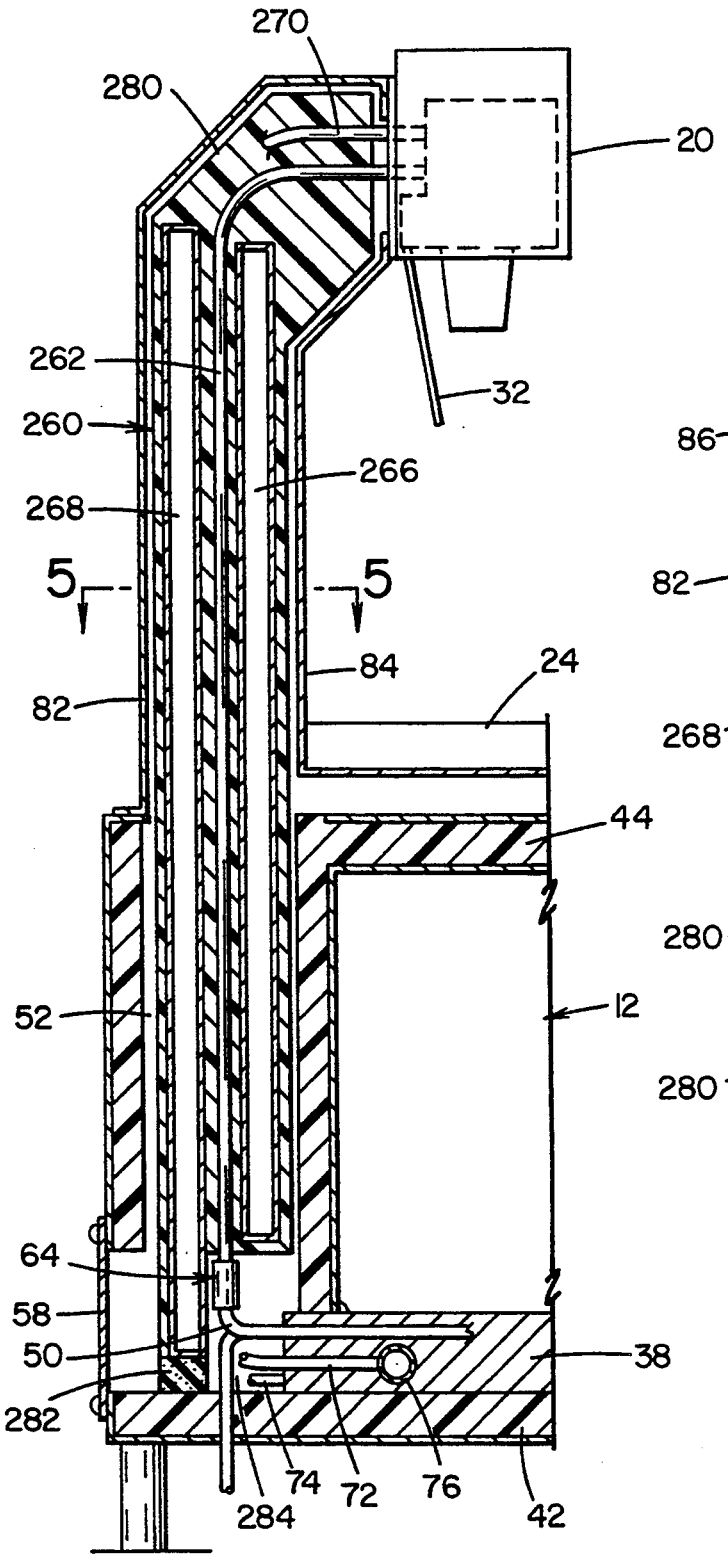
FIG. 4 is a partial cross section similar to that seen in FIG. 2 showing an alternate embodiment of the invention in which planar vacuum panels are used.
Figure 5:
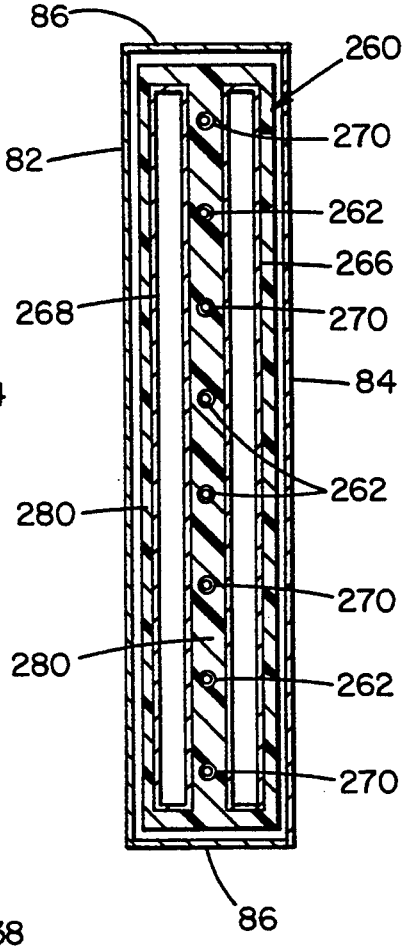
FIG. 5 is a cross sectional view of the tower structure taken along line 5—5 of FIG. 4.
Figure 11:
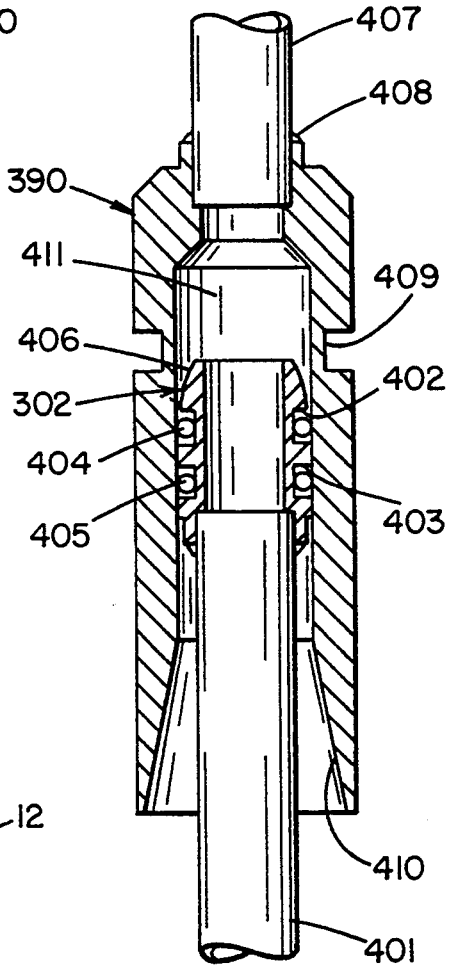
FIG. 11 shows a detail view of a conduit connector used in the embodiment of FIG. 10.
Figure 12:
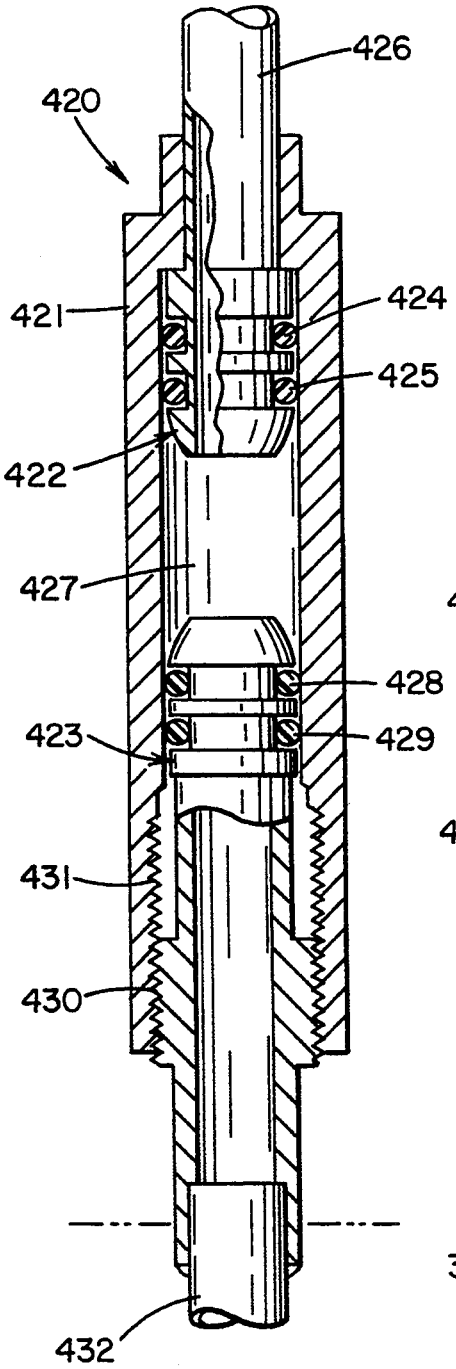
FIG. 12 shows a detail view of another alternate conduit connector.

Another embodiment of the insulated tower assembly 260 is shown in FIGS. 4 and 5. A multiplicity of syrup conduits 262 and several soda conduits 270 are sandwiched between a front vacuum insulated chamber 266 and a rear vacuum insulated chamber 268. The two vacuum insulated chambers 266, 268 define a volume enclosing the syrup conduits 262 and soda conduits 270 over the majority of their length. A body of foam insulation 280 fills the volume between the two vacuum insulated chambers 266, 268 and surrounding these chambers to form the outside surfaces of the insulated tower assembly 260. The rear vacuum insulated chamber 268 extends downwardly beyond the bottom of the front vacuum insulated chamber 266. A strip of resilient foam insulation 282 is adhesively affixed to the bottom of the rear vacuum insulated chamber 268. When the preassembled insulated tower assembly is lowered into the well 52, the ice chest syrup tube exit portions 50 and the ice chest soda tubes 72 are guided into the connectors 64 by the bell-shaped bottom opening 94. The strip of resilient foam insulation 282 is compressed against the bottom insulation 42 providing a sealed, vacuum insulated connection volume 284. The connection volume 284 is exposed to the cold plate 38 and well insulated and will hold the temperature of the cold plate 38. Alternatively, the rear vacuum insulated chamber 268 can be terminated above the access plate 58. Connectors such as those shown in FIGS. 9, 11 or 12 are then used allowing one to easily service connectors in the field.

Figure 10:
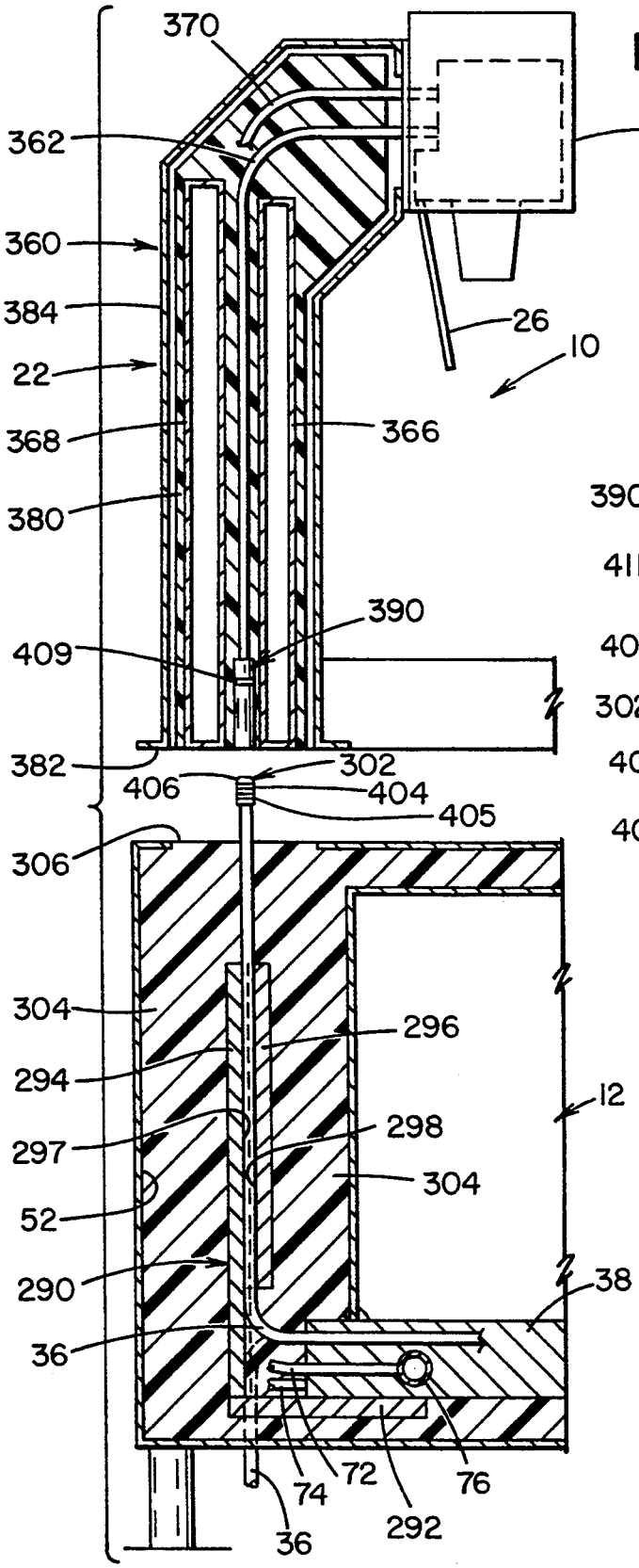
FIG. 10 is a partially exploded cross section similar to that seen in FIG. 2 showing another alternate embodiment of the present invention.

Another embodiment of the invention is shown in FIG. 10. FIG. 10 shows a dispenser 10 substantially identical in external appearance to that shown in FIG. 1. The dispenser includes an ice chest 12, dispensing head 14, a tower 22 and actuator levers 26. The ice chest 12 has a cold plate 38 at its bottom. Several ice chest syrup tubes 36 wind sinuously through the cold plate 38, exit the rear of the cold plate and run vertically up at the rear of the ice chest 12. A soda manifold 76 within the cold plate 38 feeds soda to several ice chest soda tubes 72. One ice chest syrup tube 36 and one ice chest soda tube 72 are provided for each dispenser 14. The tubes are selected to be the minimum size which will carry an appropriate flow of liquid through the dispensers. One quarter inch stainless steel tubing for syrup and 5/16 stainless steel tubing for soda is appropriate. By selecting small diameter tubing, the volume of liquid downstream from the cold plate 38 during a non-dispensing period is minimized.

Figure 14:
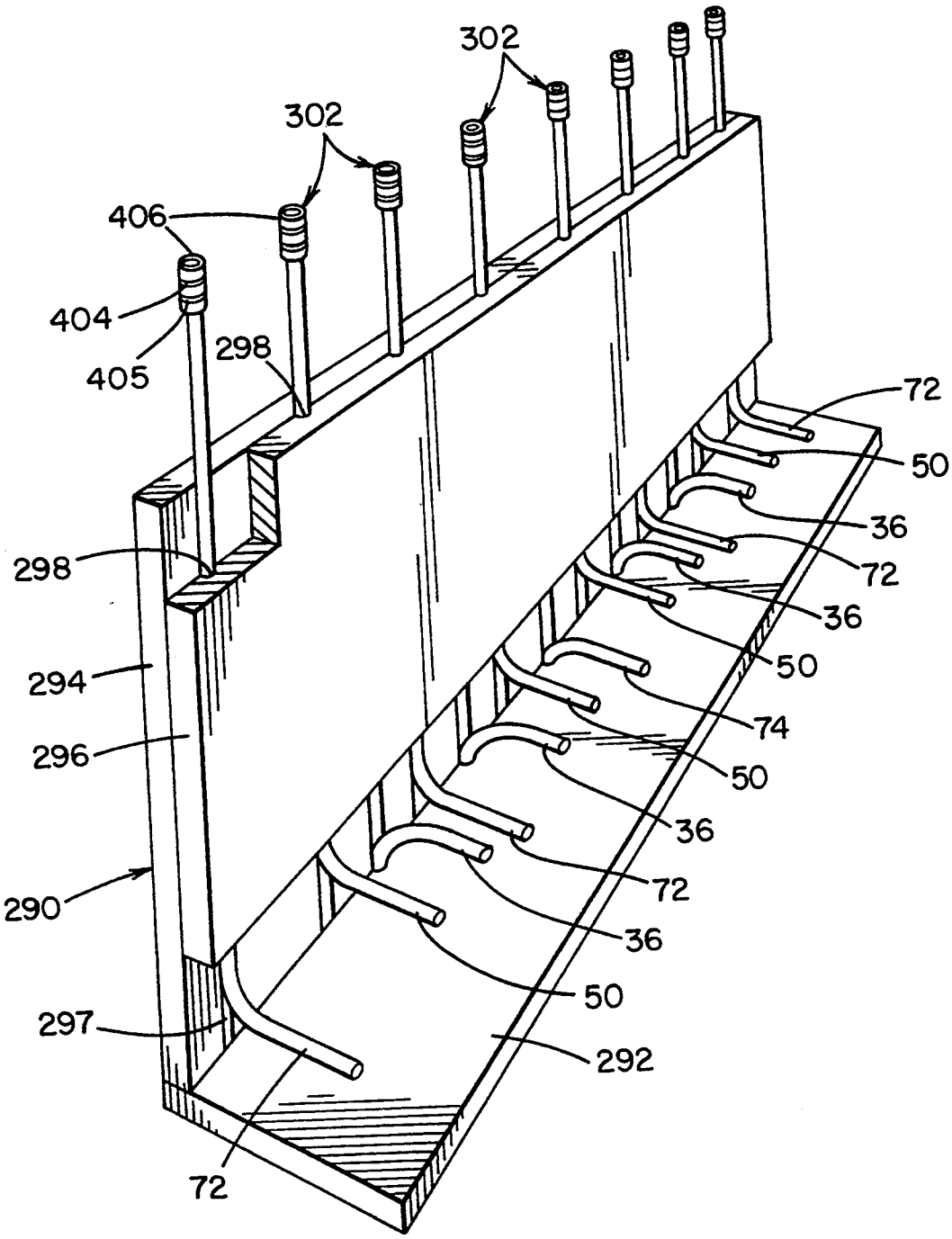

A cold plate fin assembly 290 is fixed to the bottom of the cold plate 38 by machine screws or the like. The cold plate fin assembly comprises a fin bottom 292, a fin back 294 and a fin front 296. The fin bottom 292, is a rectangular block of aluminum which extends horizontally rearwardly from the cold plate 38 and is provided with apertures allowing passage of syrup and soda feed tubes. The fin back 294, is a rectangular block of aluminum which extends upwardly from the fin bottom 292 and is bolted or otherwise fixed to the fin bottom 292. The fin back 294 is provided with grooves 297, best seen in FIG. 14, which snugly accommodate the syrup tubes 36 and soda tubes 72. The fin front 296 is a rectangular block of aluminum and has grooves 298 matching the grooves 297 in the back fin. The fin front 296 is tightly fixed, by belts or the like to the fin back The fin assembly 290 is aluminum, a good thermal conductor. It is in heat transfer contact with the cold plate 38 and the tubes 36, 72 downstream from the cold plate and embedded in an insulating mass. The tubes and their contents are kept chilled, even during long periods of inactivity.

Connector male portions 302 are welded to the top of each of the ice chest syrup tubes 36 and ice chest soda tubes 72. The tubes are trimmed prior to welding on of the connector male portions 302 so that the tops of the connector male portions 302 are generally vertically aligned. The ice chest rear well 52 is completely filled with the body of foamed in place insulation 304. The body of foamed in place insulation has a flat upper surface 306 from which the connector male portions 302 and a portion of the tubes 36, 72 protrude.

An insulated tower assembly 360 is provided above the ice chest 12. The insulated tower assembly 360 comprises a front vacuum insulated chamber 366, a rear vacuum insulated chamber 368, several syrup conduits 362 and several soda conduits 370. The syrup conduits 362 and the soda conduits 370 are sandwiched between the front and rear vacuum insulated chambers, 366, 368 over a major portion of their length. A female connector portion 390 is welded to the bottom each of the syrup conduits 362 and the soda conduits 370. A body of foamed in place insulation 380 surrounds the front vacuum insulated chamber 366 and the rear vacuum insulated chamber 368 and fills the space between them. The body of foamed in place insulation 380 is provided with a flat bottom surface 382. The female connector portions 390 have open ends flush with the flat bottom surface 382. The insulated tower assembly 360 is surrounded by a metal jacket 384. The insulated tower assembly 360 is connected to the ice chest 12 by means of screws or the like (not shown) around its periphery. When so connected, the connector male portions 302 fit into the connector female portions 390 providing a water tight seal. The flat bottom surface 382 of the body of insulation within the insulated tower assembly 360 mates with the flat upper surface 306 of the body of insulation in the rear well 52. The tubes and conduits carrying syrup and soda from the cold plate to the dispenser heads 14 are fully insulated over their entire length.

The connector portions 302, 390 are shown in greater detail in FIG. 11. The connector male portion 302 comprises a hollow cylinder welded to a syrup or soda tube 401. The male portion 302 has a central bore similar in diameter to the inside diameter of the tube 401. The male portion 302 has a generally uniform outside diameter having two recesses 402, 403 accommodating O-rings 404, 405. A tapered nose 406 is provided at the leading edge of the male portion 302.

The female portion 390 is connected to a syrup or soda conduit 407 by means of a weld 408. The female portion 390 has a generally uniform cylindrical external surface. A recess 409 is provided to allow a jig to position the connector during foaming operations. The female portion 390 is provided with an internal bore having a flared lower portion 410 tapering inwardly to a middle cylindrical portion 411. The middle cylindrical portion has a diameter slightly greater than the outside diameter of the male connector portion 302. The length of the middle cylindrical portion is selected to allow a mismatch in height of the male portion 302 and the female portion 390 of about one half inch. Thus, if the top of the male portion is one half inch below its maximum penetration of the female portion, an adequate seal between both O-rings 404 and 405 and the middle cylindrical portion 411 is obtained.

The flared bottom portion 410 and the tapered nose 406 interact during assembly to guide the male portion 302 into the female portion 390. This facilitates assembly of the insulated tower assembly 360 to the ice chest 12.

An alternative connector is shown in FIG. 12. The connector 420 of FIG. 12 comprises a cylindrical sleeve 421, an upper sealing portion 422 and a lower sealing portion 423. The upper sealing portion 422 carry's two O-rings 424, 425 in recesses. The upper sealing portion 422 is welded to a syrup or soda conduit 426 after the sleeve 421 is placed on the conduit 426.

The sleeve 421 has a central bore 427 having a diameter selected to form a water tight seal with the upper sealing part in 422 and O-rings 424, 425. The top of the bore 427 is smaller in diameter than the upper sealing element 422 preventing the sleeve 421 from sliding off the conduit but allowing it to slide upwardly. The lower sealing portion 423 includes a leading edge and two O-rings 428, 429. The lower sealing portion includes a threaded portion 430 which engages threads 431 on the sleeve 421. The lower sealing portion is welded to a syrup or soda tube 432. A water tight passage from the tube 432 to the conduit 426 is provided. The connection allows for a mismatch in the elevation of the tube and conduit with the length of the central bore 427.

Figure 13:
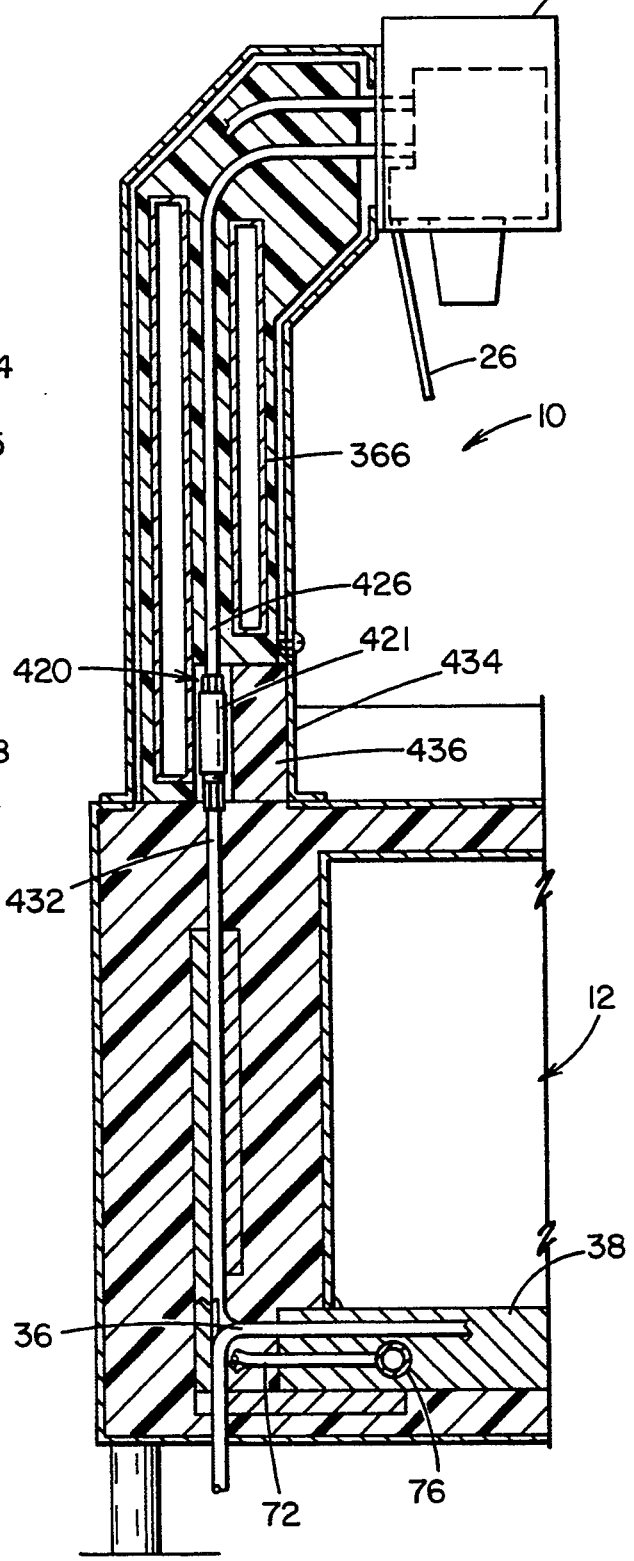
FIG. 13 is a partial cross section similar to that seen in FIG. 2 showing another alternate embodiment of the present invention, and, FIG. 14 shows the cold plate fin used in the embodiments of FIGS. 10 and 13.

FIG. 13 shows an embodiment of the invention using the connector of FIG. 12. The embodiment is identical to that shown in FIG. 10 except in the vicinity of the connector 420. The front vacuum insulated chamber 366 is vertically shortened and raised to allow access to the connector 420. An access plate 434 and access insulator 436 cover and fill the volume in front of the connectors 420. With the access plate 434 and insulator 436 removed, the connectors can be reached during assembly or servicing. When assembly or servicing is complete the insulator 436 and access plate 434 are fixed in place and conduits downstream from the cold plate 38 are well insulated.

The invention has been described with reference to the preferred embodiments. It will be appreciated that modifications or alterations could be made without deviating from the present invention. For instance, in many applications, the embedding of the soda manifold in the cold plate, the use of small diameter tubes and a cold plate fin and careful foam insulation will meet a vendors needs without the need for vacuum insulation. Such modifications and alterations will occur to others upon a reading and understanding of the specification. It is intended that all such modifications and alterations be included insofar as they come within the scope of the appended claims or the equivalents thereof.

Having thus described the invention, it is claimed:

1. An apparatus for dispensing beverages comprising: at least one soda tube receiving carbonated water from a source of carbonated water;

a plurality of syrup tubes receiving syrup from a plurality of sources of syrup;

a cooler in heat exchange relationship with said soda tube and said syrup tubes;

a plurality of dispensing heads each of said heads adapted to receive carbonated water and syrup and dispense beverage when actuated;

a tower supporting said heads; and, insulation surrounding said conduits comprising at least two spaced apart vacuum insulation panels, each of said panels being surrounded by foam insulation.

2. The apparatus of claim 1 wherein said vacuum insulated conduit package comprises at least one soda conduit and a plurality of syrup conduits, said soda conduits and said syrup conduits all being individually surrounded by a vacuum insulator for a majority of their length.

3. The apparatus of claim 2, wherein said at least one soda conduit and said syrup conduits are provided with releasable connector halves at the bottom of said conduit package and said at least one soda tube and said syrup tubes are provided with connector halves adapted to mate with said conduit connector halves.

4. The apparatus of claim 3 wherein said connector halves are flare type connector halves.

5. The apparatus of claim 3 wherein one of said tube or conduit connector halves comprises a sleeve permanently fixed to an end of each of said tubes or said conduits said sleeve having an elongate bore adapted to snugly receive the other of said tube or said conduit, the other of said tube or conduit connector halves comprising a terminal length of straight conduit.

6. The apparatus of claim 5 wherein the one of said tube or conduit which is not permanently fixed to said sleeve is adhesively bonded to said sleeve.

7. The apparatus of claim 5 wherein said elongate bore is adapted to sealingly engage the other of said tube or conduit over a one centimeter (3/8 inch) range of final mismatch.

8. The apparatus of claim 5 wherein said bore includes a circular internal recess and an elastometric O-ring is retained in said recess.

9. An apparatus for dispensing beverages comprising: at least one soda tube receiving carbonated water from a source of carbonated water;

a plurality of syrup tubes receiving syrup from a plurality of sources of syrup;

a cooler in heat exchange relationship with said soda tube and said syrup tubes;

a plurality of dispensing heads each of said heads adapted to receive carbonated water and syrup and dispense beverage when actuated;

a tower supporting said heads; and, a vacuum insulated conduit package within said tower connected to said soda tube, said syrup tubes and said dispensing heads, wherein said vacuum insulated conduit package comprises a front vacuum insulation panel, a rear vacuum insulation panel, a central space between said front insulation panel and said rear insulation panel, at least one soda conduit positioned in said central space, a plurality of syrup conduits positioned in said central space and a body of insulation surrounding said soda conduit and said syrup conduits within said central space.

10. The apparatus of claim 9 wherein said body of insulation is a body of foam insulation.

11. The apparatus of claim 9 further comprising a soda manifold positioned within said central space connected to said at least one soda conduit and to each said dispensing head.

12. The apparatus of claim 11 wherein said vacuum insulated conduit package further comprises a metal heat transfer element in heat exchange relationship with said soda manifold and in heat transfer relationship with said cooler.

13. The apparatus of claim 12 wherein said cooler comprises an ice chest type cooler having a metallic block in heat exchange relationship with said tubes and said heat transfer element is in heat transfer relationship with said metallic block.

14. The apparatus of claim 9 wherein said rear vacuum insulation panel extends downwardly beyond the bottom of said front vacuum insulation panel.

15. A method of making a carbonated drink dispenser comprising:

providing at least one soda tube adapted to accept carbonated water from a source of carbonated water;

providing a plurality of syrup tubes adapted to accept a plurality of syrups from a plurality of sources of syrup;

providing a cooler in heat exchange relationship with said at least one soda tube and said syrup tubes;

providing a tower .adapted to support a plurality of beverage dispensing heads;

providing a preassembled vacuum insulated conduit package comprising a front vacuum insulated panel, a rear vacuum insulation panel at least one soda conduit having a bottom end, and a plurality of syrup conduits each having a bottom end disposed between said front panel end said rear panel, said at least one soda conduit and plurality of syrup conduits adapted to sealingly connect to said at least one soda tube and said plurality of syrup tubes at the bottom of said preassembled vacuum insulated conduit package;

providing a plurality of beverage dispensing heads;

assembling said preassembled vacuum insulated tube package to said tower, connecting said tubes to said conduits, assembling beverage dispensing heads to said tower and connecting said beverage heads to said tubes.

16. The method of claim 15 wherein said preassembled vacuum insulated conduit package is made by:

providing at least one soda conduit and a plurality of syrup conduits, said soda conduit and said syrup conduits being adapted to connect to said soda tube and syrup tubes;

positioning said at least one soda conduit and plurality of syrup conduits between the front vacuum insulated panel and the rear vacuum insulated panel;

providing a mold adapted to create a body fitting within said tower;

positioning said conduits and panels in a preselected relationship within said mold such that said bottom ends of said conduits are all capable of being connected to said tubes;

introducing foaming elements into said mold and creating a body of foam surrounding said conduits and panels and removing said conduit containing body of foam from said mold.

17. A method of making a carbonated drink dispenser comprising:

providing at least one soda tube adapted to accept carbonated water from a source of carbonated water;

providing a plurality of syrup tubes adapted to accept a plurality of syrups from a plurality of sources of syrup;

providing a cooler in heat exchange relationship with said at least one soda tube and said syrup tubes;

providing a tower adapted to support a plurality of beverage dispensing heads;

providing a preassembled vacuum insulated conduit package comprising at least one soda conduit and a plurality of syrup conduits, said at least one soda conduit and plurality of syrup conduits having bottoms adapted to sealingly connect to said at least one soda tube and said plurality of syrup tubes at the bottom of said preassembled vacuum insulated conduit package;

wherein said preassembled vacuum insulated conduit package is made by providing at least one soda conduit and a plurality of syrup conduits, all said conduits having bottoms adapted to connect to said soda tube and syrup tube; providing a front vacuum insulating panel; providing a rear vacuum insulating panel; providing a mold adapted to create a body fitting within said tower; positioning said front and rear panels and said conduits in said mold such that said conduits are between said panels and said conduit bottoms are positioned collectively to be connected to said tubes; creating a body of foam insulation between said front and rear panels and surrounding at least the majority of each of said conduits, providing a plurality of beverage dispensing heads; and assembling said preassembled vacuum insulated tube package to said tower, connecting said tubes to said conduits, assembling beverage dispensing heads to said tower and connecting said beverage heads to said tubes.

18. An apparatus for dispensing beverages comprising:

at least one syrup tube receiving syrup from a source of syrup;

at least one soda tube receiving carbonated water from a source of carbonated water;

at least one dispensing head receiving carbonated water from said soda tube and syrup from said at least one syrup tube and adapted to dispense beverage into a container when activated;

a cooler in heat exchange relationship with a portion of said soda tube intermediate said source of carbonated water and said dispensing head; and, a portion of said soda tube intermediate said cooler and said dispensing head being disposed between a first vacuum insulated panel and a second vacuum insulated panel and surrounded by foam insulation.

19. The apparatus of claim 18 wherein said soda tube is connected to a soda manifold and a metallic heat transfer element is in heat exchange contact with said cooler and said manifold.

20. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads; and connecting means for connecting each of said tower assembly metallic conduits to each of said ice chest assembly metallic tubes each of said connecting means when said conduits and said tubes are separated by a distance of 0 to 1 inches comprising a flare connector body selected form a class of connector bodies differing in length by approximately $\frac{1}{4}$ each engaging a flare connector nut.

21. An improved beverage dispenser according to claim 20, wherein said flare connecting means comprises two flare connecting nuts.

22. An improved beverage dispenser according to claim 21, in which said flare connector includes a gasket between said flare connector body and said flare connector nut.

23. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads;

connecting means for connecting each of said tower assembly metallic conduits to each of said ice chest assembly metallic tubes each comprising a flare connector body and a flare connector nut wherein said flare connector body comprises a top opening, a bottom opening, a central bore connecting said top opening and bottom opening a lateral surface having top threads and bottom threads, an angled top surface sloping from said top opening to said top threads, and an angled bottom surface sloping from said bottom opening to said bottom threads;

and wherein said flare nut comprises a top surface having an opening, a bottom surface having an opening, a lateral surface, an angled interior surface, a threaded interior surface adjacent said bottom surface opening, a central bore connecting said top surface to said angled interior surface, said angled interior surface connecting said central bore to said threaded interior surface, said central bore having a diameter substantially equal to the outer diameter of said tower assembly metallic conduit and said ice chest assembly metallic tubing and said threaded interior surface adapted to threadably engage said top or bottom threads of said flare connector body.

24. The improved beverage dispenser of claim 23, in which the distance between said lower surface of said tower metallic conduit and the upper surface of said ice chest metallic tube is between 0 inches and 1 inches.

25. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads; and connector means for connecting said ice chest metallic tubes to said tower metallic conduits, each of said connector means comprising: an upper connector half having a bottom surface with an opening therein welded to one of said tower metallic conduits and a lower connector half welded to one of said ice chest metallic tubes.

26. An improved beverage dispenser according to claim 25, in which said upper connector half is female.

27. An improved beverage dispenser according to claim 26, in which said tower connector half is male and has a lower connector half diameter.

28. An improved beverage dispenser according to claim 27, in which said upper connector half and said lower connector half slidably engage whereby a watertight seal is formed.

29. An improved beverage dispenser according to claim 28, wherein the distance between said top surface of said lower connector half and said bottom surface of said tower metallic tube is between 0.0 and 0.5 inches.

30. An improved beverage dispenser according to claim 29, wherein said upper connector half has an elongate central bore with an upper portion having a diameter slightly larger than said lower connector half diameter, said central bore upper portion having a length adapted to allow a watertight seal with said lower connector half when said lower connector half is positioned anywhere within a one half inch range.

31. An improved beverage dispenser according to claim 30, wherein said upper connector half central bore has a lower portion which flares between said upper portion and said opening in said bottom surface of said upper connector half.

32. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads wherein each of said connector means comprise an upper connector half welded to one of said tower metallic conduits and a lower connector half welded to one of said ice chest metallic tubes wherein said connector means further comprises an upper female connector half having a lateral surface, a top opening into which one of said tower metallic tubes is welded, a flared bottom opening, a central bore having an upper portion and a flared lower portion connecting said top opening and said flared bottom opening;

a lower connector half welded to one of said ice chest metallic tubes which extends above said ice chest assembly, said lower connector half further comprising a bottom surface having an opening into which said ice chest metallic tube is welded, a top surface having an opening, and a tapered lateral surface having at least one annular recess adapted to accept an O-ring, said lateral surface tapering between said annular recess and said top surface; and a jig attachment means comprising an annular recess in said lateral surface.

33. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads; and connector means for connecting each of said tower metallic syrup and soda conduits to each of said ice chest metallic syrup and soda tubes; said connector means comprising:

an upper sealing part welded to said tower metallic conduits and having an outside diameter;

a lower sealing part having an upper portion having an upper portion diameter equal to said upper sealing part outside diameter and a lower portion of said lower sealing part welded to said ice chest metallic tubes; and a sleeve slidably mounted on said tower conduit, said sleeve having a central bore including a sealing area, said central bore sealing area having a constant diameter slightly larger than said upper sealing part outside diameter.

34. The improved beverage dispenser of claim 33, in which said lower sealing part has external threads, said sleeve has internal threads, and said tower sealing part and said sleeve are screw threadedly engaged.

35. The improved beverage dispenser of claim 34, wherein said lower sealing part has a lateral surface including at least one annular recess therein to accommodate an O-ring.

36. The improved beverage dispenser of claim 35, wherein said lower sealing part has a-top surface and wherein said lateral surface tapers between said annular recess and said top surface.

37. The improved beverage dispenser of claim 33, wherein said sleeve further includes an upper bore portion having a diameter approximately equal to the diameter of said tower metallic tubes and less than said diameter of said central bore sealing area.

38. The improved beverage dispenser of claim 34, wherein said upper sealing part has a bottom surface-,and the distance between said upper sealing part bottom surface and said lower sealing part top surface is between 0.0 and 1.0 inches.

39. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower, a plurality of metallic syrup conduits having diameters and bottom surfaces connected to said drink dispensing heads and a plurality of metallic soda conduits having diameters and bottom surfaces connected to said drink dispensing heads;

an upper sealing part having a top surface having an opening therein, a bottom surface having an opening therein, a lateral surface including at least one annular recess adapted to accommodate an O-ring, a central bore connecting said opening in said top surface with said opening in said bottom surface, said upper sealing part having an outer diameter greater than the diameter of said lower metallic conduit;

a lower sealing part including a top surface having an opening therein, a bottom surface having an opening therein and welded to one of said ice chest metallic tubes, a central bore connecting said opening in said top surface with said opening in said bottom surface, a lateral surface having at least one annular recess adapted to accommodate an O-ring, and a threaded portion, said lower sealing part having an outer diameter greater than the diameter of said ice chest metallic tube; and a sleeve including a top surface having an opening therein, a bottom surface having an opening therein extending into a central cavity having interior threads for a distance from said opening in said bottom surface, and an upper bore Connecting said opening in said top surface with said central cavity, said upper bore having a diameter approximately equal to the diameter of said lower metallic conduit, and said central cavity having a diameter approximately equal to the diameter of said upper and lower sealing parts;

wherein the distance between said top surface of said lower sealing part and said bottom surface of said upper sealing part is between 0.0 and 1.0 inches.

40. A method of connecting an ice chest assembly to a tower assembly wherein said ice chest assembly includes an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein; and said tower assembly includes drink dispensing heads, a supporting tower, a plurality of metallic conduits having diameters and bottom surfaces connected to said drink dispensing heads and a plurality of metallic soda conduits having bottom surfaces and diameters connected to said drink dispensing heads said method comprising the steps of:

placing a flare connector nut over said ice chest metallic tube;

placing a flare connector nut over said tower metallic conduit;

flaring said tube and said conduit;

aligning said ice chest metallic tube with said tower metallic conduit;

selecting a flare connector from a class of flare connectors differing in length by approximately $\frac{1}{4}$ inch;

placing said flare connector between said ice chest metallic tube and said tower metallic conduit;

screwthreadedly engaging said flare connector and said flare connector nuts.

41. An improved beverage dispenser comprising an ice chest assembly including an ice chamber having a bottom, said chamber adapted to receive a body of ice, a cold plate forming at least a portion of said ice chamber bottom and a body of insulation thermally protecting said ice chamber; said cold plate comprising a thermally conductive metallic body having a plurality of metallic syrup tubes having top surfaces and a plurality of metallic soda tubes having top surfaces embedded therein;

an insulated tower assembly comprising drink dispensing heads, a supporting tower including a front panel having an access opening therein, said access opening comprising a removable panel located in said front panel and proximate to said connector means, a plurality of metallic syrup conduits connected to said drink dispensing heads and a plurality of metallic soda conduits connected to said drink dispensing heads; and connector means comprising a sleeve element attached to each of said conduits for connecting said tower metallic conduits to said ice chest metallic tubes when the distance between said tubes and said conduits is between 0 and 1 inches said conductor means accessible through said access opening, wherein said tower assembly includes a front vacuum insulated chamber and a rear vacuum insulation cheer adjacent said metallic tubes.

42. An improved beverage dispenser according to claim 41, wherein said front vacuum insulated chamber has a bottom and said bottom is above said access opening.

43. An improved beverage dispenser according to claim 42, including an access insulator between said access panel and said connector means, said access insulator comprising a body of foam insulation contoured to fill the volume between said connectors and said access panel.

44. An improved beverage dispenser according to claim 43, in which said access insulator is removable.

45. The improved beverage dispenser according to claim 43, wherein-said tower contains a body of foam insulation above said access opening and said body of insulation includes recesses allowing said connection to be disengaged from said ice chest and slid upwardly for maintenance, assembly or disassembly.

* * * * *